United States Patent [19]

Leitz

[11] 4,073,078

[45] Feb. 14, 1978

[54] ADJUSTABLE DREDGING AND TRENCHING APPARATUS

[76] Inventor: Julius H. Leitz, 6211 N. Ensign, Portland, Oreg. 97217

[21] Appl. No.: 628,116

[22] Filed: Nov. 3, 1975

[51] Int. Cl.[2] ..... E02F 3/00

[52] U.S. Cl. ..... 37/77; 37/73; 114/294

[58] Field of Search ..... 37/77, 76, 75, 78, 79, 37/73, 74, 72, 64, 65, 66, 67, 61, 62, 63, 58, 59; 114/206 R, 294, 311

[56] References Cited

U.S. PATENT DOCUMENTS

| | | | |
|---|---|---|---|
| 142,577 | 9/1873 | Morse | 37/77 |
| 261,587 | 7/1882 | Cram | 37/73 |
| 328,095 | 10/1885 | Walsh | 37/67 |
| 471,108 | 3/1892 | Duryee | 37/58 |
| 799,256 | 9/1905 | Parker | 37/58 |
| 1,019,610 | 3/1912 | Donnelly | 37/67 |
| 1,587,187 | 6/1926 | Schmutte | 37/77 |
| 1,962,363 | 6/1934 | Reimel et al. | 37/73 X |
| 2,361,404 | 10/1944 | Kalix | 37/67 |
| 3,187,447 | 6/1965 | Hollyoak | 37/78 |
| 3,218,739 | 11/1965 | Kaufmann et al. | 37/67 X |
| 3,470,633 | 10/1969 | Soehnlen | 37/73 X |

FOREIGN PATENT DOCUMENTS

| | | | |
|---|---|---|---|
| 4,406 of | 1891 | United Kingdom | 37/78 |

*Primary Examiner*—Clifford D. Crowder
*Attorney, Agent, or Firm*—Kolisch, Hartwell, Dickinson & Stuart

[57] ABSTRACT

A stowable agitation trenching apparatus for use on a vessel such as a dredge or barge includes an adjustable, vertically extendable and retractable eongate leg slidably disposed within a mounting bracket pivotally secured to the vessel for selectively disposing a distal end of the leg at a plurality of positions underneath the vessel. An agitation producing propeller is disposed adjacent to the distal end and is movable therewith for producing an eroding current of water against the bottom surface of a body of water to be trenched or dug. The vertically extendable and retractable elongate leg is arranged to be raised and pivoted in the mounting for substantially horizontal stowage on the vessel.

24 Claims, 5 Drawing Figures

ADJUSTABLE DREDGING AND TRENCHING APPARATUS

BACKGROUND OF THE INVENTION

A. Field of the Invention

The present invention relates to dredges and barges, and more particularly to a portable dredge which incorporates a vertically extendable and retractable leg to which an agitation propeller is mounted for producing an eroding current which will cavitate the bottom surface of a body of water and thereby dig a trench or dissipate bottom material.

It is often desirable to dig trenches or remove earth material from the bottom of a harbor, bay or river and ocean channels in order to permit passage of deep draft vessels or to remove objectionable underwater foliage. For example, sand waves in river and ocean channels must be periodically dissipated to enable vessels to pass therethrough. It has been found that agitation dredging, i.e., the use of a driven propeller for producing an eroding current of water, is a preferable method. However, in order to trench a deep furrow in a harbor or ocean floor or to enlarge and clean out a river channel or area to be enclosed by a bay, an agitation propeller must be capable of descending to considerable depths (upwards of 40 feet) and further be adjustable to permit arrangement over a variable bottom surface.

Typically, dredging machines are used to trench channels, etc. and take the form of a rather large substantial structures utilizing a shovel or scoop similar to a scoop used on a land steam shovel. The mechanical shovel or scoop is used to bring up mud, sand, rocks, etc. from a bottom surface. However, these large dredges are extremely heavy and difficult to move around and the length of the shovel boom necessarily dictates the depth to which such a dredge can dig into the bottom surface. The present invention avoids the above problem by employing adjustable agitation dredging, i.e., dredging by a propeller-driven unit secured to a vertically extendable and retractable leg which is disposed adjacent to a bottom surface and actuated to produce an eroding current for digging away or displacing sand or gravel or bottom muck for redistribution. It is desirable to have a readily portable dredge in order to increase the efficiency of digging a trench and for readily accessible movement to subsequent projects. Agitation dredging has been found to be quite efficient, and the present invention contemplates the use of an agitation prop arranged on a vertically extendable and retractable leg means which is pivotally mounted to a side portion of a dredge. The pivotal mounting enables the vertically adjustable extendable and retractable leg means and agitation prop to be stowed in a substantially horizontal position adjacent to the vessel. Such horizontal stowing is preferable when it is desired to move the portable dredge to a subsequent project or location without being impeded by the drag of a below-surfaced agitation prop. Furthermore, the present invention utilizes a retracting spud foot for materially assisting in slowing down movement of the portable dredge when conventional anchors are used off the bow and stern to secure movable enclosing lines to driven winches. Furthermore, the present invention enables the agitation prop to be swung in a substantially horizontal plane adjacent to a bottom surface in order to produce a trench having a predetermined breadth. The agitation prop may be raised or lowered by means of a winch and line for selective positioning adjacent the bottom surface.

B. Description of the Prior Art

Agitation trenching apparatuses are known in the art, and a typical example is exemplified by U.S. Pat. No. 3,440,743 which discloses an underwater trenching apparatus using axial flow propellers under the hull of a vessel for producing current flow in a direction extending aft of the hull in order to enable trenches of differing widths to be readily produced. An adjustable deflecting means is arranged aft of the propellers in order to selectively deflect the eroding current in a plurality of positions adjacent to the bottom surface to be trenched. This patent does not disclose a stowable agitation prop which may be vertically extended or retracted to enable trenching of bottom surfaces located substantially below the upper surface of a body of water. Furthermore, this patent does not disclose an impeding spud foot or the like to slow down movement of the vessel.

Another prior art patent of relevance is U.S. Pat. No. 723,122 which discloses a hydraulic dredge provided with a steam engine adapted to operate a hydraulic pump. The dredge disclosed incorporates a suction pipe adapted to be raised and lowered with a swinging frame in order to displace or wash away earth which is first loosened by a plow arrangement. The bow of the vessel is normally pivoted by means of a spud which passes through a vertical guideway in a transverse center of the bow and acts as a pivot on which the stern of a boat is adapted to swing laterally through an arc. The arc is adjusted by means of side anchors and ropes and may also be raised. However, it is readily apparent that the vessel described in this patent does not provide for flexibility of an agitation prop on a horizontally stowable vertically extendible and retractible leg.

Norwegian Pat. No. 63,383 discloses an agitation trenching device which incorporates a propeller located on the aft portion of a boat which directs a current of eroding water downward against a surface to be dug. Disposed behind the agitation propeller is a rod which apparently is placed in the bottom earth surface in order to slow the vessel down somewhat. It is readily apparent that the arrangement disclosed in this patent does not enable the trenching or digging of a channel at substantial depths below the waterline of the vessel. The disclosure in the Norwegian patent contemplates the use of an agitation prop secured to the vessel and not movable vertically with respect thereto.

Additional trenching or underwater grading devices are disclosed in U.S. Pat. Nos. 659,122, 2,856,704 and 3,010,231. These patents are deemed relevant but not worthy of further comment.

SUMMARY OF THE INVENTION

The present invention provides for a portable dredge utilizing a stowable agitation trenching apparatus for use thereon which incorporates a vertically extendable and retractable elongate leg adapted to be pivotally mounted to a vessel for selective positioning at a plurality of locations underneath the vessel. An agitation propeller is arranged on a distal end of the leg and is employed to produce an eroding current of water adjacent to and contacting the bottom surface. An impeding spud means such as a spud foot is secured to one end of the vertically extendable and retractable elongate leg and is insertable into the bottom surface for obstructing or braking forward and reverse as well as lateral movement of the vessel to permit the agitation prop to fully wash away or dig a desired trench. The vertically extendable and retractable elongate leg is additionally pivotally mounted in a bracket or housing which may be swung about an axis extending substantially transversely of the dredge to permit substantially horizontal above water stowage of the agitation trenching apparatus on the vessel. In another embodiment of the present invention, the retractable impeding spud is replaced by a dragging chain which serves to substantially obstruct or brake movement of the vessel.

An object of the present invention is to provide an agitating trenching apparatus which may be vertically arranged underneath the vessel to a plurality of desired depths. To provide such a flexible depth capability, the present invention contemplates the use of an agitation prop arranged on a distal end of a vertically retractable and extendable leg means which may be moved upwardly through a bracket or housing disposed on a side portion of the vessel by means of a winch and cable to thereby compensate for varying depth conditions.

Another object of the present invention is to provide an impeding means disposed alongside the vertically retractable and extendable leg means for insertion into the bottom surface to obstruct or brake forward and reverse as well as lateral movement of the vessel to prevent the agitation prop from providing excessive forward drive and thereby permitting the agitation prop ample time to erode a trench.

Another object of the present invention is to provide a portable dredge which may be readily removed to channels or areas which have low hanging foliage or are only accessible if a vessel first passes beneath a low bridge. In such circumstances, it is apparent that a dredging apparatus must be horizontally stowable upon the vessel or must be dragged behind or beneath in the water. If a trenching apparatus is dragged behind or beneath a vessel, transportation is correspondingly slow and inefficient. The present invention provides for an agitation trenching device which may be disposed at substantial depths, i.e., upwards of forty feet below the waterline of the vessel to trench or dig channels in relatively deep waterways while also being capable of substantially horizontal stowage upon the vessel for unimpeded transportation of same.

Additional objects of the present invention reside in the specific construction of the exemplary apparatus hereinafter particularly described in the specification and shown in the several drawings.

BRIEF DESCRIPTION OF THE DRAWINGS

Novel features of the improved, adjustable trenching apparatus in accordance with the present invention will be more readily understood from a consideration of the following description taken together with the accompanying drawings, in which exemplary adaptations are illustrated with the various parts thereof identified by suitable reference characters in each of the views, and in which.

DETAILED DESCRIPTION OF THE INVENTION

Figure 1:
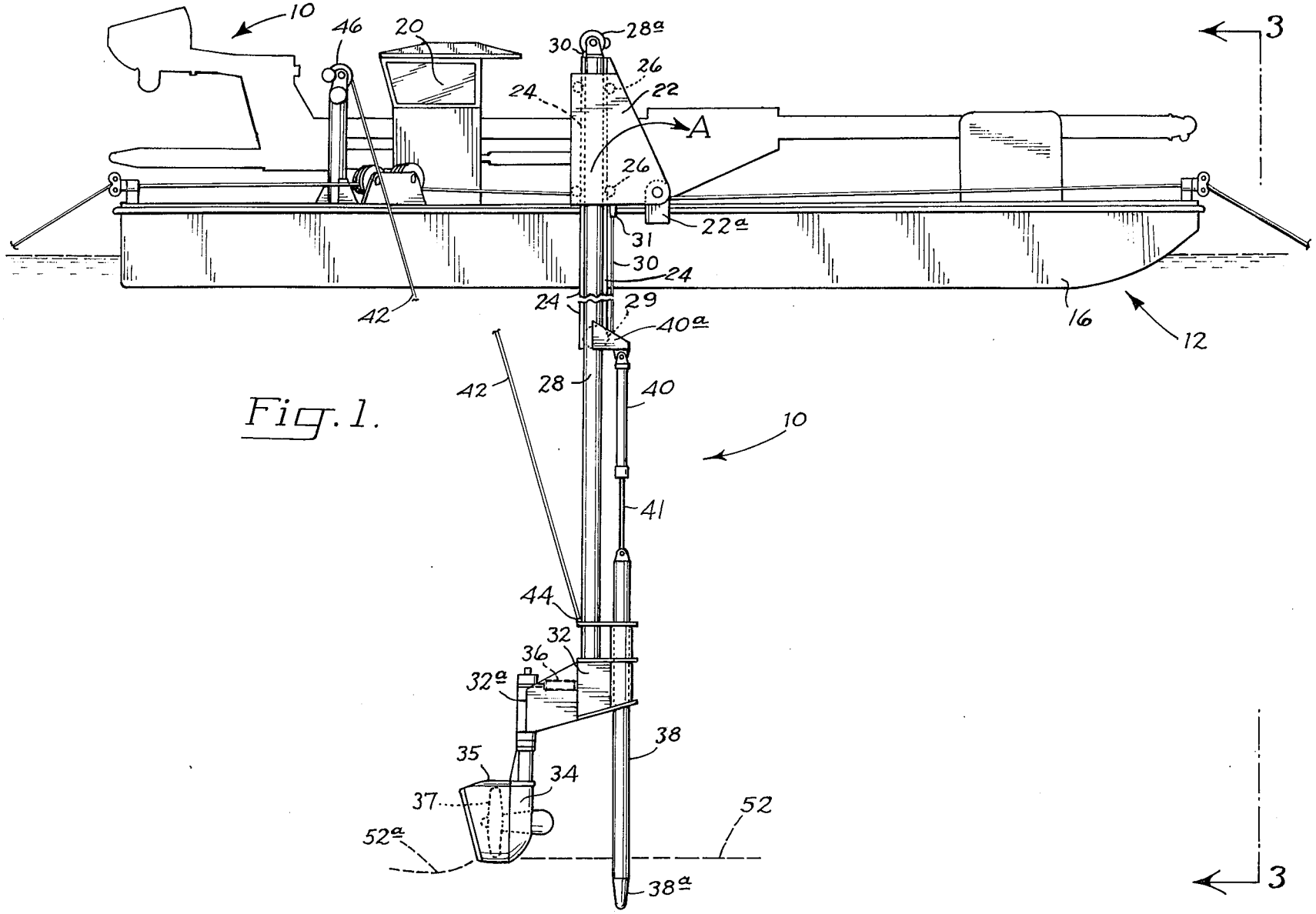
FIG. 1 is a side view of a portable dredge with the trenching apparatus of the present invention shown disposed against a bottom surface. The trenching apparatus is also shown in dotted lines in its horizontally stowed position.
Figure 2:
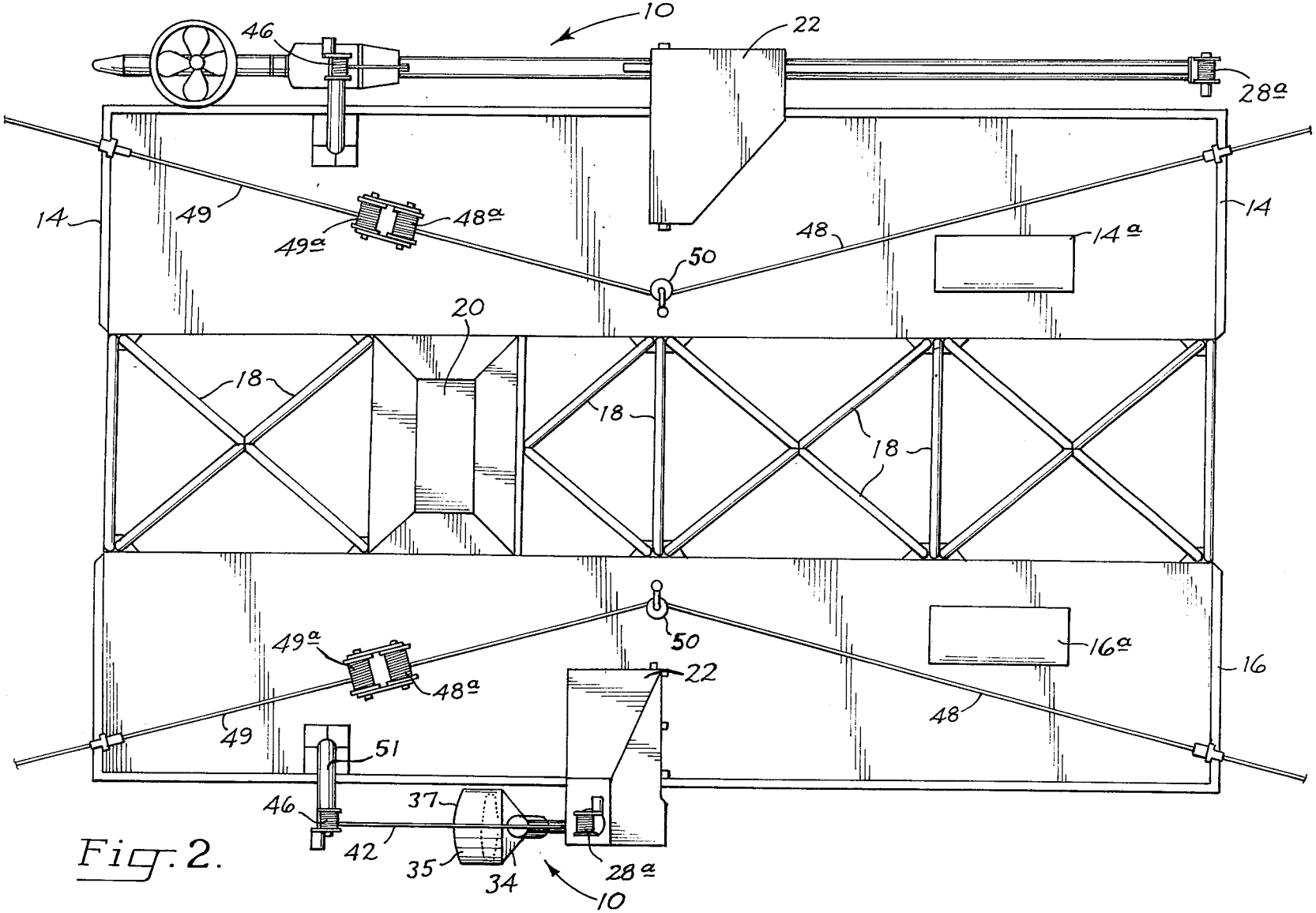
FIG. 2 is a top view of FIG. 1 and illustrates port and starboard arrangement of the trenching apparatus.
Figure 3:
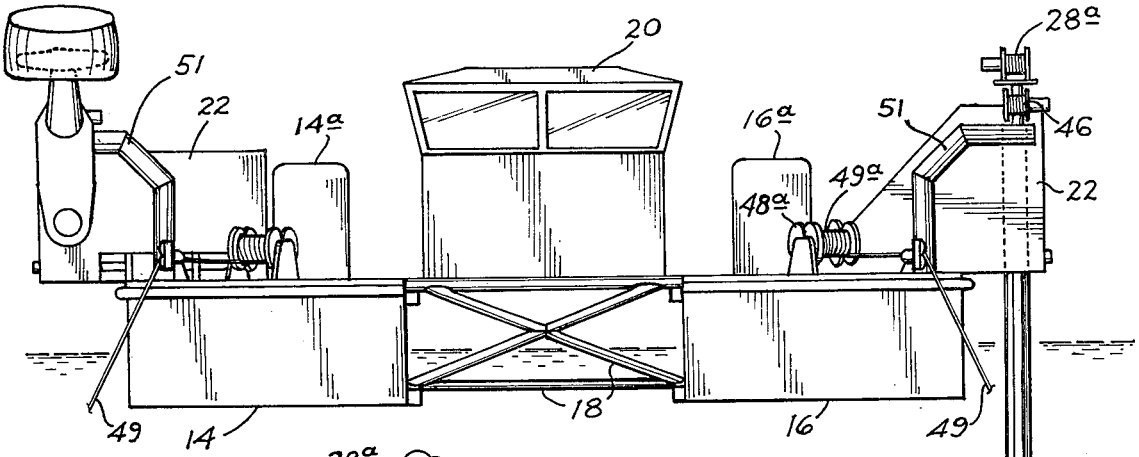
FIG. 3 is a view taken along lines 3—3 of FIG. 1.

Referring initially to FIG. 1 of the drawings, there is illustrated an embodiment of the stowable trenching apparatus of the present invention generally designated at 10. Stowable trenching apparatus 10 is secured to port and starboard sides of a dredge, generally designated at 12. Dredge 12 consists of two pontoons 14 and 16 which are rigidly secured together by a network of transversely extending beams 18 (see FIG. 2).

A removable control and monitoring station 20 is disposed substantially amidships. FIG. 1 illustrates starboard stowable trenching apparatus 10 arranged in its vertically extended position for trenching.

A housing 22 is pivotally mounted on dredge 12 by means of a support **22*a*. Extending through housing 22 is an elongate by means such as leg 28. Leg 28 is provided with fixed, opposed rails or tracks 24 which extend from adjacent the top of leg 28 to a point intermediate its length. Guide means 26 are provided on housing 22 to cooperate with tracks 24 so that leg 28** is slidably received within the housing.

A sheave 29 is connected to leg 28 adjacent the lower end of tracks 24. Supported on top of leg 28 is a hoisting winch **28*a* which is connected to one end of a leg hoisting cable 30. Cable 30 is passed around sheave 29 and has its other end connected to housing 22 at 31. Thus, it may be appreciated that as leg hoisting winch 28*a* reels in leg lifting cable 30, leg 28 is raised upwardly through housing 22. Likewise, when leg hoisting winch 28*a* pays out leg hoisting cable 30, leg 28 may be vertically lowered. At a distal end of leg 28 there is arranged a bracket 32 to which is pivotally secured an agitation propeller means 34 having props 37. Agitation propeller means 34 is pivotal about axis 32*a* in a substantially horizontal plane by means of an actuating cylinder (hidden behind bracket arm 36). An impeding spud means for penetrating the bottom includes an elongate spud foot 38 slidably mounted within an extension of bracket 32. Spud foot 38 extends upwardly to a fluid actuated piston and rod 40, 41 which is operable for selectively shifting spud foot 38 along its longitudinal axis relative to the longitudinal axis of leg 28. An upper bracket 40*a* attach piston and rod assembly 40, 41 adjacent to sheave 29 and spud foot 38 is mounted with its longitudinal axis generally parallel to the longitudinal axis of leg 28. A lifting cable 42 is secured to inner leg 28 at 44, and is wound about a stowing and steadying winch 46 which may be hydraulically driven. Stowing and steadying winch 46 is arranged on top of an angled winch support 51**.

The operation of the stowable agitation dredging apparatus of the present invention will now be hereinafter particularly described. Initially portable dredge 12 is transported to a particular river or lake bed which is to have its bottom surface trenched or dug. Portable dredge 12 is transported to a particular job site with stowable agitation dredging apparatus 10 in its substantially horizontal stowed position as shown on the port side of dredge 12 in FIG. 2. When dredge 12 is disposed over a bottom surface to be trenched, a positioning lead cable 48 and paying out cable 49 are anchored at respective ends either to the bottom surface to be trenched or to a shoreline. A positioning winch 48*a* and paying out positioning winch 49*a* maintain constant tension and are arranged to operatively drive dredge 12 either in a forward or aft direction. Positioning lead cable 48 is operatively connected to positioning winch 48*a* through a snatch block 50. From its stowed position, trenching apparatus 10 of the present invention may be gradually lowered by permitting stowing and steadying winch 46 to pay out lifting cable 42. At an appropriate depth, leg 28 may be further disposed downwardly toward the bottom 52 by paying out leg hoisting cable 30 by means of operating leg hoisting winch 28*a*. Thus, agitation prop 34 may be disposed downwardly against bottom 52.

When agitation prop 34 is actuated, it will produce an eroding current which will dig or wash away a trench 52*a* due to cavitation. Additionally, shrouds 35 may be arranged in a manner about agitation prop 34 to direct the eroding current in a predetermined desired direction. Spud foot 38 may be operatively disposed by means of fluid actuating means 40, 41 to a position beneath surface 52 to serve as a mooring, or partial mooring device. Spud foot 38 utilizes a somewhat sharpened point 38*a* to facilitate penetration thereof into surface 52. Spud foot 38 serves as an impediment to forward travel caused by the operation of agitation prop 34. If more drag is required, spud foot 38 may be disposed to a predetermined depth below surface 52. Furthermore, if no drag is required, as when agitation prop 34 is removing a particularly thick muck or the like, spud foot 38 may be completely retracted from surface 52 to thereby provide no drag.

From the foregoing description, it may be appreciated that dredge 12 can use both agitating trenching devices at once or only one while keeping the other stowed. When it is desired to raise agitation trenching apparatus 10, agitation prop 34 (conveniently being hydro driven) is first deactuated and spud foot 38 is retracted from surface 52. Thereupon, leg hoisting winch 28*a* is actuated to pull leg 28 somewhat up through housing 22. At this point, stowing and steadying winch 46 is drivingly actuated to reel in lifting cable 42. As lifting cable 42 is reeled in, it can be seen that tracks 24 will be slidably directed through guides 26 while mounting bracket 22 pivots about support 22*a* in the direction of arrow A. Eventually, the entire stowable agitation assembly 10 will be pivotally drawn upwards to the position indicated by trenching apparatus 10 on the port side of dredge 12. At this point, steadying and stowing winch 46 is locked securely and portable dredge 12 may be removed to another area for trenching.

Figure 4:
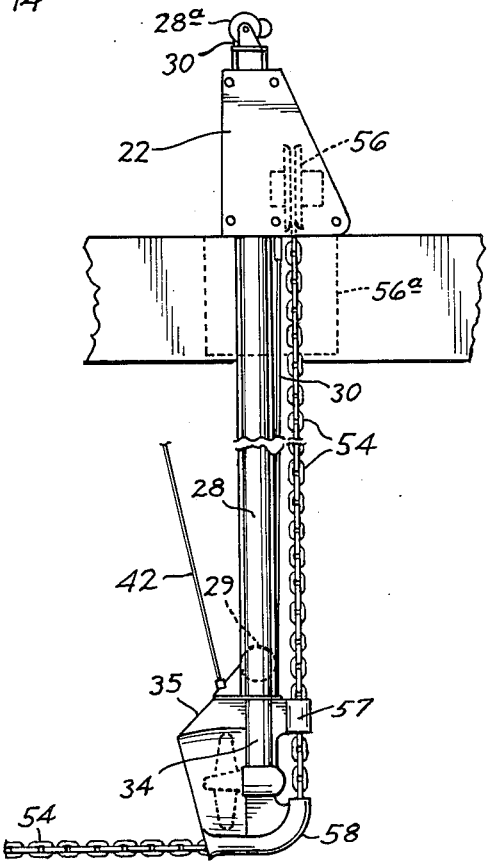
FIG. 4 is another embodiment of the present invention showing a drag chain used to impede forward travel.
Figure 5:
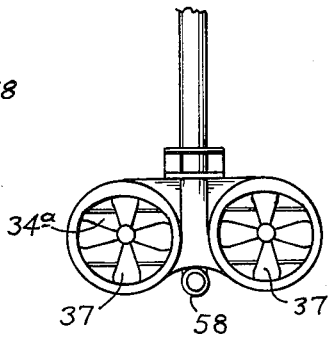
FIG. 5 is a view illustrating use of multiple agitation props.
Figure 5:
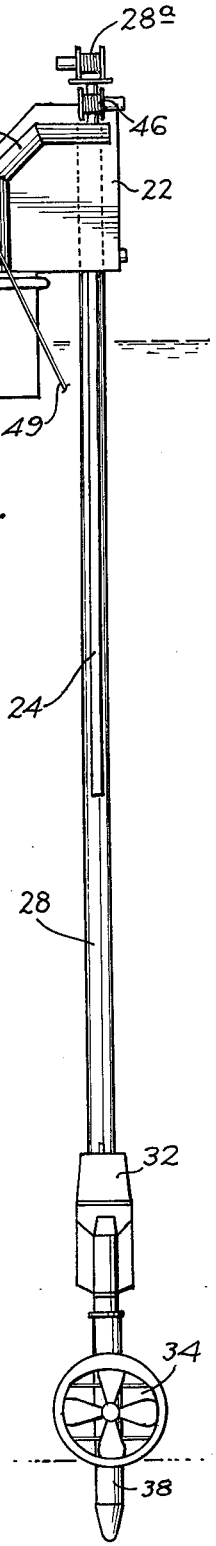

FIG. 4 shows another embodiment of the present invention which utilizes a chain 54 instead of spud foot 38 to provide drag. Specifically, chain 54 depends from windlass 56 and chain locker 56*a* through fairleads 57 and 58 to a rearward position of agitation prop 34. Instead of a rigid foot digging into the ground to provide impediment, chain 54 provides a somewhat more flexible drag especially advantageous for swell compensation.

If it is desired to dig a wider trench or a trench in a shorter period of time, a plurality of agitation props 34, 34*a*, etc. may be arranged about bracket 32 to provide for an increased trenching capability.

Several advantages of the present invention may be readily seen. First of all, it is to be appreciated that vertically retractable and extendable leg 28 slidably disposed within housing 22 permits placement of agitation prop 34 at substantial depths. Furthermore, pivotal mounting means 22 enables stowing and steadying winch 46 to raise a lifting cable 42 and thereby horizontally stow agitation trenching assembly 10 quickly and efficiently. Spud foot 38 is conveniently arranged to penetrate a bottom surface 52 to provide material impediment to forward or reverse travel of portable dredge 12. Such impediment to travel is required when a substantial trench is to be dug. An additional advantage to the present invention resides in the use of a pivotally arranged agitation prop 34 to thereby permit a wider trench to be dug.

The various winches are mechanically driven by suitable power plants 14*a*, 16*a* appropriately arranged in a known manner, i.e., gasoline or diesel engines driving hydraulic pumps, etc.

While the invention has been particularly shown and described with reference to the foregoing embodiments thereof, it will be understood by those skilled in the art that other changes in form and detail may be made therein without departing from the spirit and scope of the invention as defined in the appended claims.

What is claimed is:

1. A stowable agitation dredging and trenching apparatus for use on a vessel comprising:

elongate leg means;

a housing adapted to be pivotally mounted on the vessel for slidably receiving said leg means, said housing adapted to be swung between a position permitting said leg means to be vertically extended or retracted and a position for substantially horizontally stowing said leg means;

power driven agitation means disposed adjacent to a distal end of said leg means for producing an eroding current of water against the bottom surface of a body of water; and impeding means mounted on said leg means including a spud foot and means selectively operable for shifting said spud foot relative to said leg means for penetration into the bottom surface.

2. The apparatus as defined in claim 1 wherein fluid actuated means are provided for selectively operating said spud foot alongside said leg means.

3. The apparatus as defined in claim 2 wherein said agitation means is pivotally connected adjacent the distal end of said leg means for selective positioning about a substantially horizontal plane relative to said leg means when it is vertically extended for permitting digging of a trench of a predetermined breadth.

4. The apparatus as defined in claim 3 wherein additional agitation means are arranged to cooperate with said first mentioned agitation means.

5. The apparatus as defined in claim 1 wherein said spud foot is mounted with its longitudinal axis generally parallel to the longitudinal axis of said leg means.

6. The apparatus as defined in claim 1 wherein said agitation means includes propeller means mounted with its axis substantially perpendicular relative to the longitudinal axis of said leg means.

7. The apparatus as defined in claim 1 wherein said leg means includes track means extending along a portion of its length, said track means being slidably received within guide means mounted on said housing.

8. The apparatus as defined in claim 7 wherein means are provided on said leg means operable for selectively extending and retracting said leg means relative to said housing.

9. In combination, a vessel and a stowable dredging and trenching apparatus comprising:

elongate leg means;

a housing pivotally mounted on said vessel for slidably receiving said leg means, said housing being swingable between a position permitting said leg means to be vertically extended and retracted and a position for substantially horizontally stowing said leg means;

power driven agitation means disposed adjacent to a distal end of said leg means for producing an eroding current of water against the bottom surface of a body of water; and impeding means mounted on said leg means including a spud foot and means selectively operable for shifting said spud foot relative to said leg means for penetration into the bottom surface.

10. The combination as defined in claim 9 wherein said spud foot is mounted with its longitudinal axis generally parallel to the longitudinal axis of said leg means.

11. The combination as defined in claim 9 wherein fluid actuated means are provided for selectively operating said spud foot alongside said leg means.

12. The combination as defined in claim 11 wherein said agitation means is pivotally connected adjacent the distal end of said leg means for selective positioning about a substantially horizontal plane relative to said leg means when it is vertically extended for permitting digging of a trench of a predetermined breadth.

13. The combination as defined in claim 12 wherein additional agitation means are arranged to cooperate with said first-mentioned agitation means.

14. The combination as defined in claim 9 wherein said agitation means includes propeller means mounted with its axis substantially perpendicular relative to the longitudinal axis of said leg means.

15. The combination as defined in claim 9 wherein said leg means includes track means extending along a portion of its length, said track means being slidably received within guide means mounted on said housing, means being provided on said leg means operable for selectively extending and retracting said leg means relative to said housing, and wherein means mounted on said vessel operatively connected to said leg means are provided for moving said leg means between vertical and horizontal positions relative to said vessel.

16. A stowable agitation dredging and trenching apparatus for use on a vessel comprising:

elongate leg means;

a housing adapted to be pivotally mounted on the vessel for slidably receiving said leg means, said housing adapted to be swung between a position permitting said leg means to be vertically extended or retracted and a position for substantially horizontally stowing said leg means;

power-driven agitation means disposed adjacent to a distal end of said leg means for producing an eroding current of water against the bottom surface of a body of water;

fairleads mounted on said leg means;

impeding means mounted adjacent said leg means including chain means inserted through said fairleads; and means operable for selectively paying out lengths of said chain means to be dragged behind said agitation means in the bottom surface.

17. The apparatus as defined in claim 16 wherein said leg means includes track means extending along a portion of its length, said track means being slidably received within guide means mounted on said housing.

18. The apparatus as defined in claim 17 wherein means are provided on said leg means operable for selectively extending and retracting said leg means relative to said housing.

19. The apparatus as defined in claim 18 wherein said agitation means is pivotally connected adjacent the distal end of said leg means for selective positioning about a substantially horizontal plane, when said leg means is vertically disposed, for permitting digging of a trench of a predetermined breadth.

20. The apparatus as defined in claim 19 wherein additional agitation means are arranged to cooperate with said first-mentioned agitation means.

21. In combination, a vessel and a stowable dredging and trenching apparatus comprising:

elongate leg means;

a housing pivotally mounted on said vessel for slidably receiving said leg means, said housing being swingable between a position permitting said leg means to be vertically extended and retracted and a position for substantially horizontally stowing said leg means;

power-driven agitation means disposed adjacent to a distal end of said leg means for producing an eroding current of water against the bottom surface of a body of water;

fairleads mounted on said leg means;

impeding means mounted adjacent said leg means including chain means inserted through said fairleads; and means operable for selectively paying out lengths of said chain means to be dragged behind said agitation means in the bottom surface.

22. The combination as defined in claim 21 wherein said agitation means is pivotally connected adjacent the distal end of said leg means for selective positioning about a substantially horizontal plane relative to said leg means when it is vertically extended for permitting digging of a trench of a predetermined breadth.

23. The combination as defined in claim 22 wherein additional agitation means are arranged to cooperate with said first-mentioned agitation means.

24. The combination as defined in claim 21 wherein said leg means includes track means extending along a portion of its length, said track means being slidably received within guide means mounted on said housing, means being provided on said leg means operable for selectively extending and retracting said leg means relative to said housing, and wherein means mounted on said vessel operatively connected to said leg means are provided for moving said leg means between vertical and horizontal positions relative to said vessel.

* * * * *